United States Patent [19]

Jou

[11] Patent Number: 5,026,261

[45] Date of Patent: Jun. 25, 1991

[54] COMPACT AIR PUMP

[76] Inventor: Wen-San Jou, No. 258-4, An Chia Tsun, An Ting Hsiang, Tainan Hsien, Taiwan

[21] Appl. No.: 425,969

[22] Filed: Oct. 24, 1989

[51] Int. Cl.[5] ..... F04B 21/02; F16L 37/18

[52] U.S. Cl. ..... 417/555.1; 239/390; 285/312; 417/234; 417/313

[58] Field of Search ..... 417/234, 313, 555.1, 417/555.2, 569; 239/390; 285/311, 312, 326

[56] References Cited

U.S. PATENT DOCUMENTS

| | | | |
|---|---|---|---|
| 1,362,374 | 12/1920 | Twombly | 417/555.1 |
| 1,409,220 | 3/1922 | Leighty et al. | 239/390 |
| 2,539,846 | 1/1951 | Lewis et al. | 417/555.1 |
| 2,576,687 | 11/1951 | Krehbiel | 417/313 |
| 3,738,688 | 6/1973 | Racine | 285/312 |
| 3,819,302 | 6/1974 | Ohashi | 417/234 |
| 3,923,325 | 12/1975 | Slater, Jr. | 285/312 |
| 4,508,490 | 4/1985 | Ramirez et al. | 417/234 |

FOREIGN PATENT DOCUMENTS

| | | | |
|---|---|---|---|
| 130150 | 7/1919 | United Kingdom | 239/390 |

*Primary Examiner*—Leonard E. Smith
*Assistant Examiner*—M. Kocharov
*Attorney, Agent, or Firm*—Morton J. Rosenberg; David I. Klein

[57] ABSTRACT

This invention relates to an improved portable air pump and in particular to one that utilizes a compressing rod, a cylinder and a base to pump air in the object that requires air. By pressing the compressing rod down, air will be forced to flow through a one way valve into an air duct and blow out of an air outlet. The spring will return the compressing rod to its original position because of its elastic force. A force block shall cause the cylinder to move forward so that a squeezer may squeeze a rubber fixture to eliminate an air gap so that air will not flow toward other directions but air nozzle as desired.

1 Claim, 5 Drawing Sheets

COMPACT AIR PUMP

BACKGROUND OF THE INVENTION

Prior art air pumps may be generally placed into one of two categories, i.e. electrically operated air pumps, and manually operated air pumps. The subject improved compact air pump is directed to manually operated air pumps. In general, manual air pumps are in themselves categorized into two different types. In one type of prior art air pump the operator must have a foot stabilization member and the pumping of air is accomplished by compressively displacing air within an air cylinder using both hands and standing on the foot stabilizing member to maintain positional placement and stabilization of the air pump. In the other type of air pump known to Applicant, actuation is by foot displacement of the user. However, in both types of manual air pumps, such are direct themselves to a singular function. Further, air pumps of the prior art have specialized functions and may only be applicable to specific tasks such as air pumps for filling tennis balls and such pumps are not usable for other objectives and purposes.

The subject Patent Application is directed to an improved compact air pump which is multi-functional and portable.

SUMMARY OF THE INVENTION

It is a primary objective of the present invention concept to provide an improved portable air pump which is multi-functional in its use.

It is a further objective of the present invention concept to provide an improved portable air pump which is convenient to use by an operator.

It is still another object of the present invention to produce an improved portable air pump which is easy to manually carry and may be stored in a simple manner. It is still a further object of the present invention to provide an improved portable air pump which is inexpensive to manufacture.

DETAILED DESCRIPTION OF THE PREFERRED EMBODIMENTS

Figure 2:
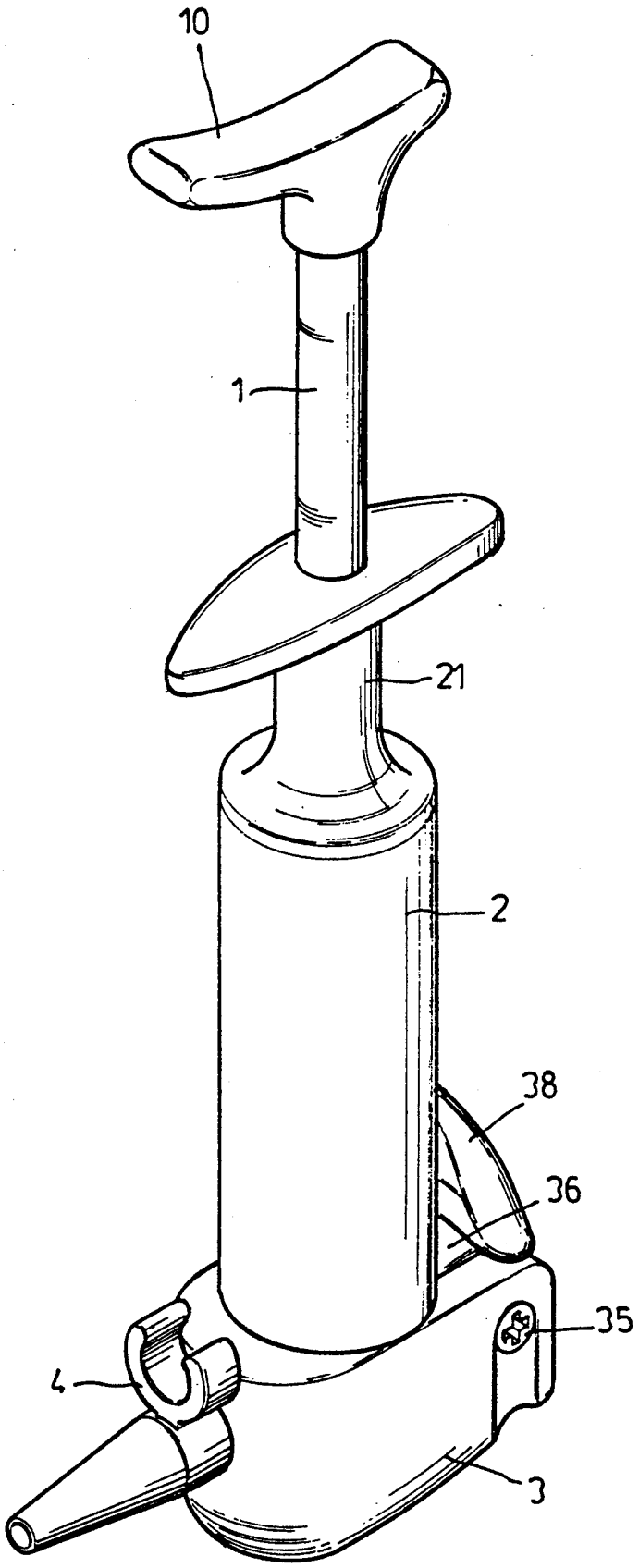
FIG. 2 is a perspective view of the compact air pump of this invention.
Figure 3:
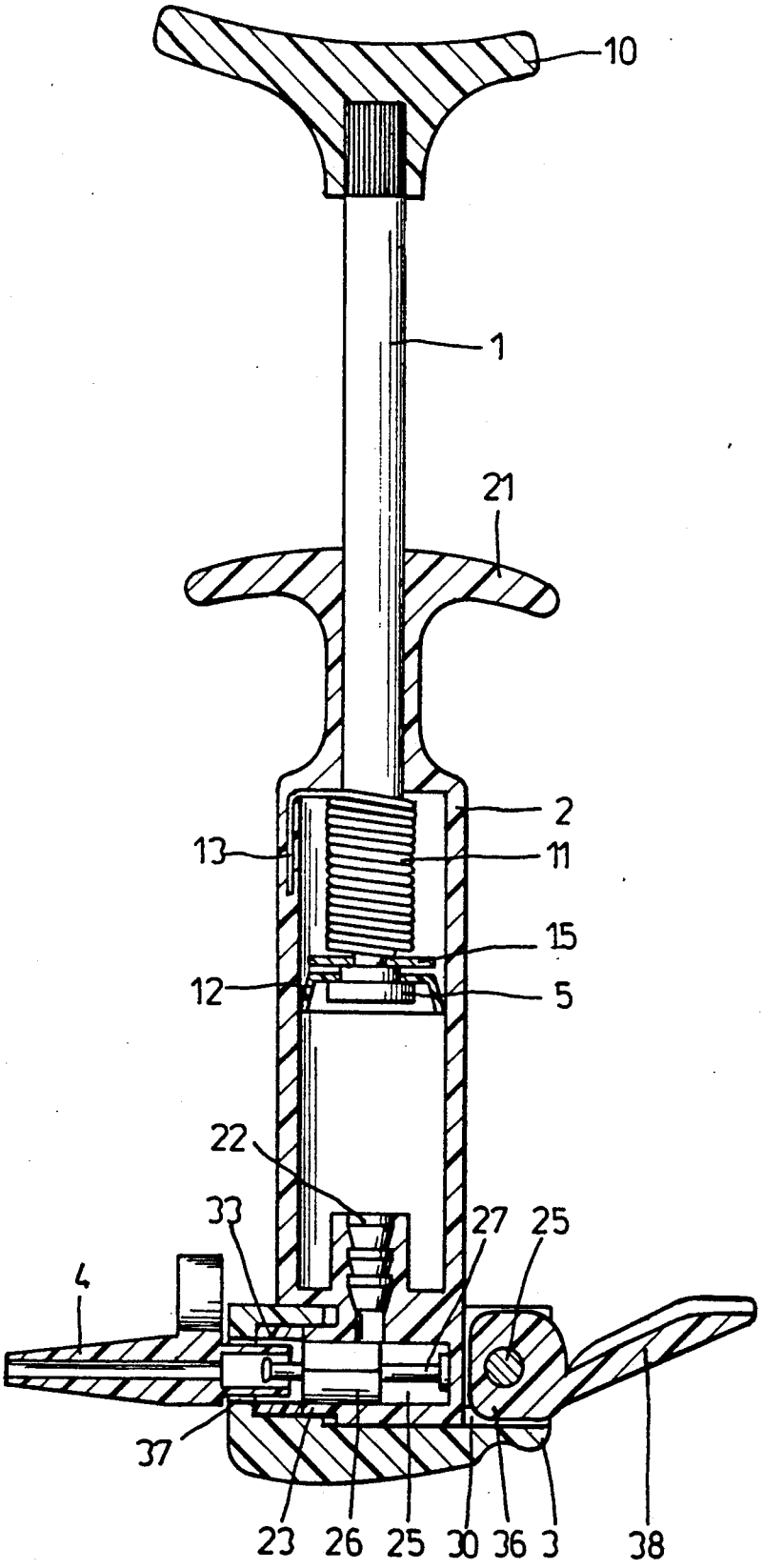
FIG. 3 is a cross-sectional view of the compact air pump showing the air pump in an open position.
Figure 4:
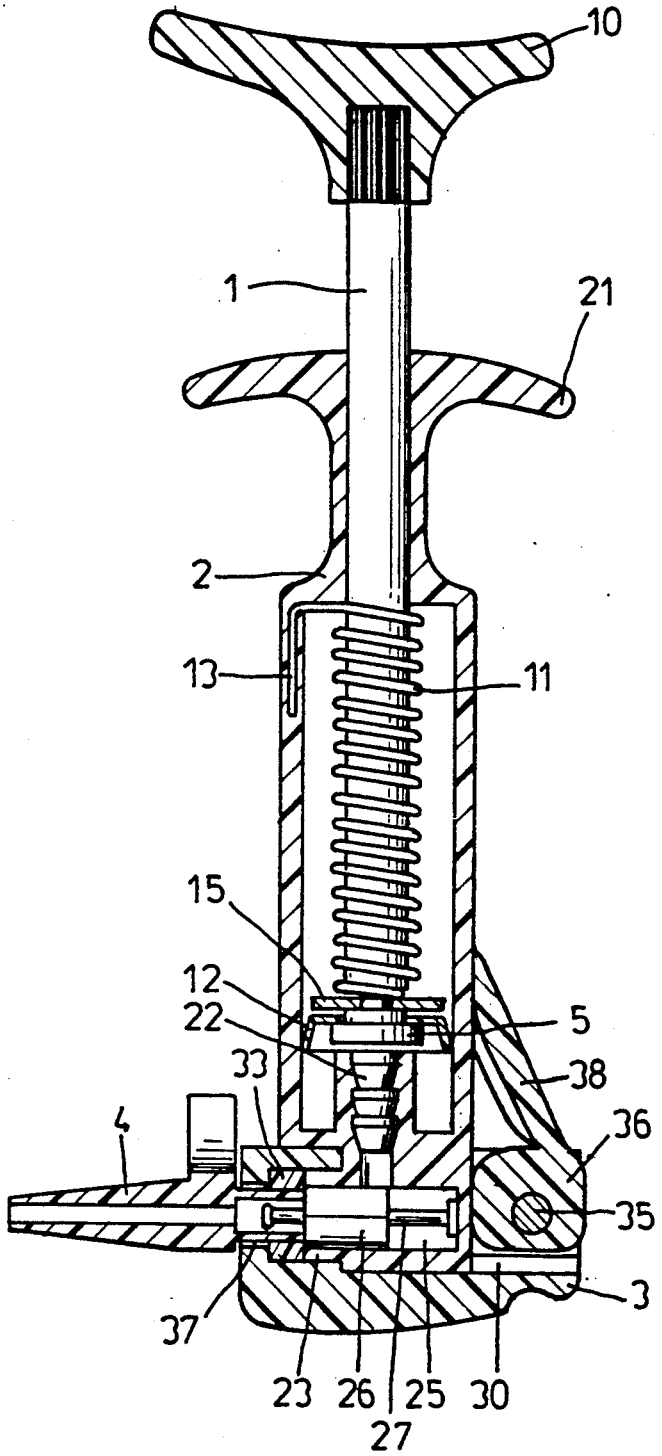
FIG. 4 is a cross-sectional view of the compact air pump of the subject invention in an air compressed position; and, FIG. 5 is a perspective view of the compact air pump in use.

Referring now to FIGS. 1–4 there is shown a portable air pump including an air cylinder housing 2, a base member 3, and air nozzle 4 for passing air to an external medium responsive to a manual actuation by a user, as is clearly shown in FIG. 4.

Figure 1:
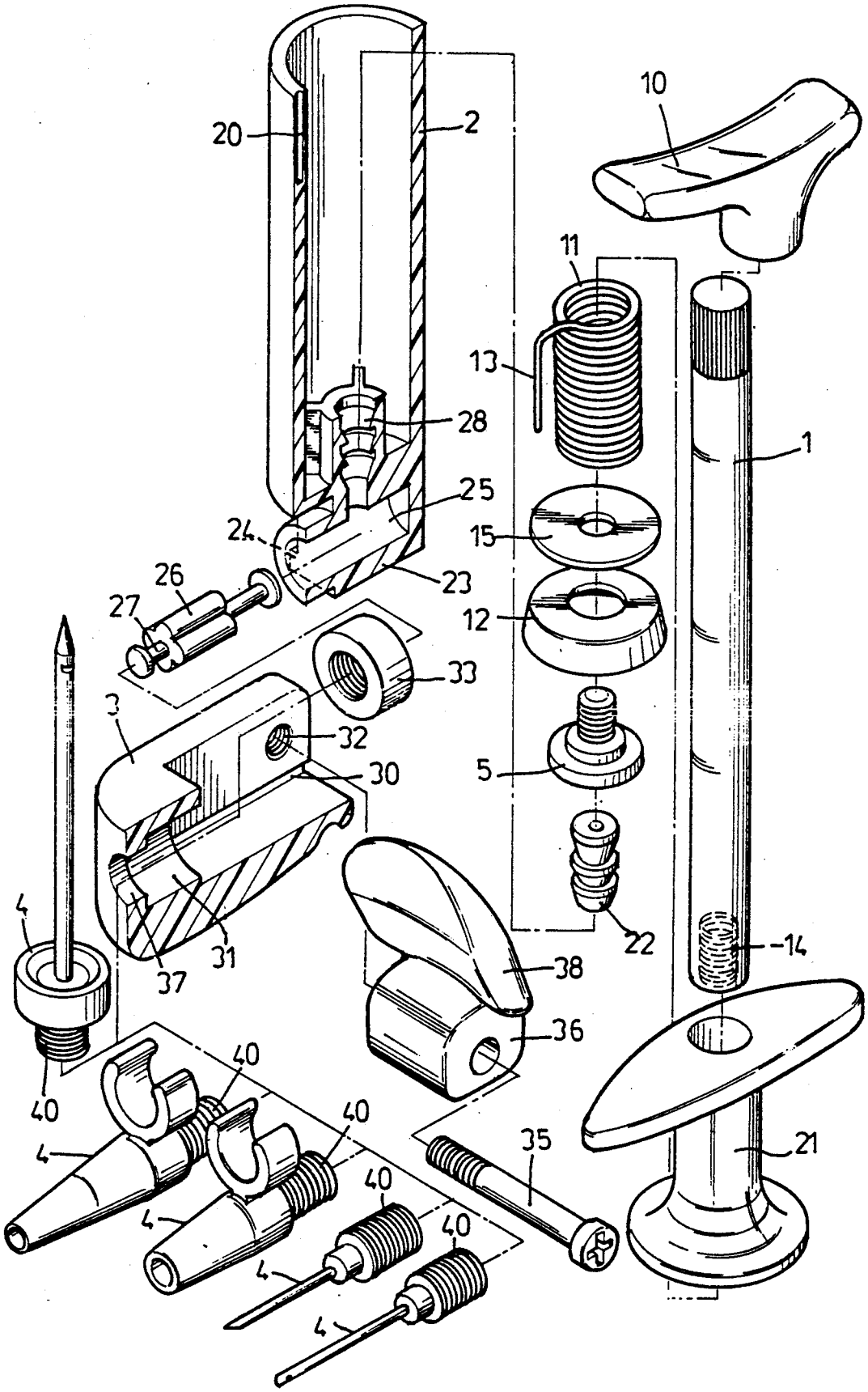
FIG. 1 is an exploded perspective partially cross-sectioned view of the compact air pump of this invention.

Air cylinder housing 2 includes a vertically directed upper compartment as is seen in FIG. 1 and a horizontally directed lower compartment 25 with the upper and lower compartments in fluid communication through valve seat member 28 having a through opening as is seen in FIG. 1. As seen in FIG. 2 a one-way or check valve member 22 is operatively positioned and located within valve seat member 28 between air cylinder housing upper compartment and air cylinder housing lower compartment 25. In this manner, as will be described in following paragaphs, manual actuation of the portable air pump allows air to be forced forced check valve member 22 in a singular direction for passage of air through air nozzle member 4, while maintaining a block for air to be passed from lower compartment 25 to the upper compartment of air cylinder housing 2.

Air compression rod member 1 includes handle 10 which is fixedly secured to a first end of air compression rod 1 as is seen in FIGS. 2–4. Grip member 21 is fixedly mounted to an upper surface of air cylinder housing 2 for an integral connection therewith as is seen in FIGS. 2 and 3. Air compression rod 1 passes through and is slidably displaceable with respect to grip member 21 to allow relative vertical displacement of air compression rod 1 with respect to the upper compartment of air cylinder housing 2. Air compression rod 1 is slidably mounted to both air cylinder housing 2 and grip member 21 to allow reversible vertical displacement of air compression rod 1 as is seen in FIGS. 3 and 4.

Air compression rod 1 includes a blind threaded hole 14 formed at a second end thereof 1. Helical spring 11 surrounds air compression rod 1 and is mounted thereon. Helical spring 11 includes hook portion 13 which is insertable within air cylinder housing recess or groove 20. In this manner, the overall air compression rod is spring biased to an open position as is shown in FIG. 3. When air compression rod 1 is displaced in a downward direction to force air through nozzle 4, it can be seen that there is a spring force in an upward vertical direction as is operatively seen in FIG. 4 to drive the portable air pump to an open condition as is seen in FIG. 3. Thus, the helical spring member 11 including the retaining hook member 13 causes a spring biasing. Washer member 15 is mounted on air compression rod 1 and has a diameter greater than the outside diameter of the helical spring memler to maintain the helical spring member 11 in a fixed position on air compression rod 1. Mounted on air compression rod 1 is drum contoured air compression member 12 and as is seen in FIGS. 3 and 4 contiguously interfaces with an internal wall surface of air cylinder housing 2 in the upper compartment as air compression rod 1 is slidingly displaced therein.

Threaded or screw memler 5 is threadedly secured to air compression rod 1 within a blind threaded hole 14 to secure the component parts contained within the upper compartment of air cylinder housing 2. The portable air pump includes air cylinder housing displacement member 36 having a handle 38 where handle 38 and displacement member 36 are rotatable to compressively couple air cylinder housing 2 to base member 3 by compressively deforming and elastic displacement member 33 therebetween as is seen in FIGS. 3 and 4. Elastic displacement member 33 may be a rubber disk member having a through opening as is seen in FIG. 1. Base member 3 includes air outlets 31 and 37 which define through openings to allow air to pass to air nozzle 4. Air outlet 31 has a larger internal diameter than air outlet 37 defining a shoulder therebetween within which is inserted elastic member 33.

As seen in FIG. 1, air cylinder housing displacement member 36 includes a through opening adapted for insertion of bolt member 35 wherein the through opening has a sufficiently large diameter to allow rotation of members 36 and 38 about the axis of bolt member 35. Bolt member 35 is fixedly secured to base member 3 within threaded opening 32. When the handle 38 is rotated between the position shown in FIG. 3 to the position shown in FIG. 4, a camming action takes place as the displacement member 36 displaces the air cylinder 2 with respect to the base 3 and the elastic ring fixture 33 is compressed between the block 23 and the shoulder within base 3 to allow tight coupling around the air nozzle 4.

Base member 3 interfaces with outer wall 23 defined by lower compartment 25 to allow relative displacement therebetween responsive to rotation of air cylinder housing displacement memler 36 when handle 38 is rotated from the position seen in FIG. 3 to the position seen in FIG. 4. As has previously been described, when handle 38 is rotated from a position shown in FIG. 3 to a position shown in FIG. 4 elastic displacement disk member 33 is compressively displaced within the confines provided by the shoulder defined in the different diameters provided by air outlet openings 31 and 37. As shown in FIGS. 3 and 4, elastic ring fixture 33 is mounted within air outlet 31 and around an end of air nozzle 4. In FIG. 3 the elastic ring fixture 33 is loosely mounted around the end of air nozzle 4 and in FIG. 4 the ring fixture 33 is compressed by displacement of block 23 to tightly encompass the end of the air nozzle 4 to avoid loss of air as air is forced into the air nozzle 4.

As is seen in FIG. 1, lower compartment outer wall 23 includes shoulder portion 24 which slidingly interfaces with base member undercut section 30 to slidingly capture air cylinder housing 2 with respect to base member 3.

Additionally, there is included air guide block member or stick 27 having scalloped portion 26 which is positionally located at least partially within air cylinder lower compartment 25 for guiding air in a horizontal direction through air outlet passages 31 and 37 to air nozzle 4 which may be threadedly secured through threaded members 40. Stick member 27 may be used to fill air in a vehicle tire and the overall contour is adapted to displaceably contact a vehicle tire pin to allow air to be passed through air cylinder housing 2 and through air nozzle 4 into the vehicle tire. In general air inlet to tires is controlled by a check valve mounted on the tire (not part of the present invention). Such check valves have a spring pin or plug inside the check valve. When filling a tire, the spring pin is displaced to allow air to pass from a pump into the tire. The stick 27 has as its function, the displacement of a standard spring pin to allow air to flow therethrough. The stick 27 has the scalloped portion 26 surrounding it and mounted in the air duct 25 to provide a positional central location for the stick 27 while the scalloping contour allows for an air passage.

Figure 5:
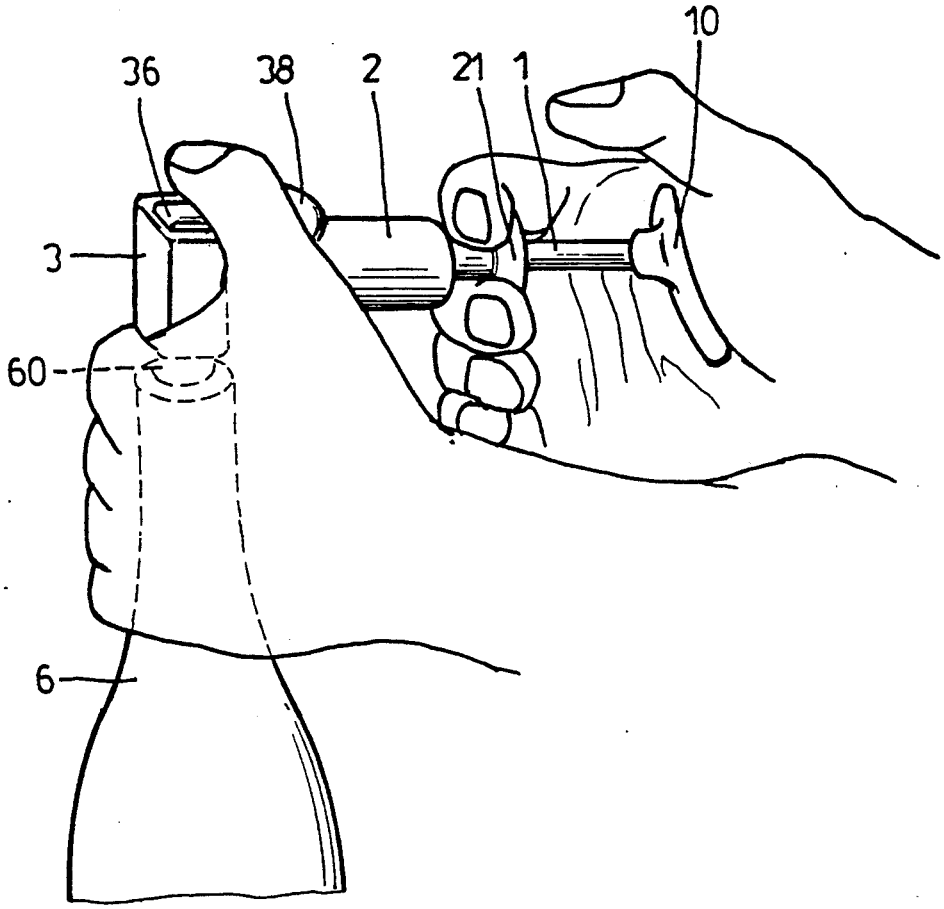

FIG. 5 shows an operational use of the portable air pump when filling bottle 6. In such applications, bottle 6 may include a plug 60 which can be ejectively removed from bottle 6 due to the inner pressure of bottle 6 being continuously increased if a pointed of air nozzle 4 is passed therethrough and air is continuously inserted into bottle 6.

I claim:

1. A portable air pump comprising:

(a) an air cylinder housing having a vertically directed upper compartment and a horizontally directed lower compartment, said air cylinder upper and lower compartments being in fluid communication;

(b) a check valve positionally located within a valve seat member between said air cylinder upper and lower compartments;

(c) an air compression rod member having a handle fixedly secured to a first end thereof, said air compression rod member being slidably mounted to a grip member, said grip member being coupled to said air cylinder housing at an upper surface thereof;

(d) a drum contoured air compression member secured to a second end of said air compression rod member for contiguously interfacing with an internal wall surface of said air cylinder housing compartment as said air compression rod member is slidingly displaced therein;

(e) a helical spring member surrounding said air compression rod member, said helical spring member having a retaining hook member formed on one end thereof for coupling to air cylinder housing within a groove formed therein;

(f) a base member displaceably coupled to said air cylinder housing and in fluid communication with said air cylinder lower compartment, said base member having an air outlet passage formed through a first end thereof, an elastic disk shaped member mounted in said base member and having a through opening and axially aligned with said air outlet passage for allowing flow of air therethrough;

(g) an air cylinder housing displacement member rotatively coupled to a second end of said base member, said displacement member being rotatable to displace said air cylinder housing with respect to said base member and compressively couple said air cylinder housing to said base member by compressively deforming and releaseably capturing said elastic disk shaped member therebetween; and, (h) an air guide block member positionally located at least partially within said air cylinder lower compartment for guiding air in a horizontal direction through said air outlet passage of said base member to an air nozzle member secured to said first end of said base member.

* * * * *